United States Patent [19]

Norén

[11] 4,156,503

[45] May 29, 1979

[54] METHOD AND A DEVICE FOR SWIVELLING A SPRAY NOZZLE ABOUT A SWIVELLING AXIS

[75] Inventor: John P. Norén, Upplands Väsby, Sweden

[73] Assignee: Stabilator AB, Sweden

[21] Appl. No.: 801,807

[22] Filed: May 31, 1977

[30] Foreign Application Priority Data

Jun. 1, 1976 [SE] Sweden ..... 7606186

[51] Int. Cl.[2] ..... B05B 15/08

[52] U.S. Cl. ..... 239/11; 239/187; 239/587

[58] Field of Search ..... 239/165, 187, 227, 587

[56] References Cited

U.S. PATENT DOCUMENTS

| | | | |
|---|---|---|---|
| 3,153,510 | 10/1964 | Brannfors et al. | 239/587 X |
| 3,531,054 | 9/1970 | Pülk | 239/587 |
| 3,860,175 | 1/1975 | Westerlund et al. | 239/165 |
| 3,957,203 | 5/1976 | Bullard | 239/165 X |

*Primary Examiner*—Robert W. Saifer

*Attorney, Agent, or Firm*—O'Brien and Marks

[57] ABSTRACT

A method and a device for swivelling a spray nozzle, especially for spraying concrete, over a sector between two turning positions. The speed of the swivelling movement is kept constant, regardless of the nozzle attitude. By overriding an automatic swivel control unit, the turning positions can be replaced, and once the override ceases, automatic swivelling resumes between the new turning positions.

10 Claims, 6 Drawing Figures

METHOD AND A DEVICE FOR SWIVELLING A SPRAY NOZZLE ABOUT A SWIVELLING AXIS

Figure 1:
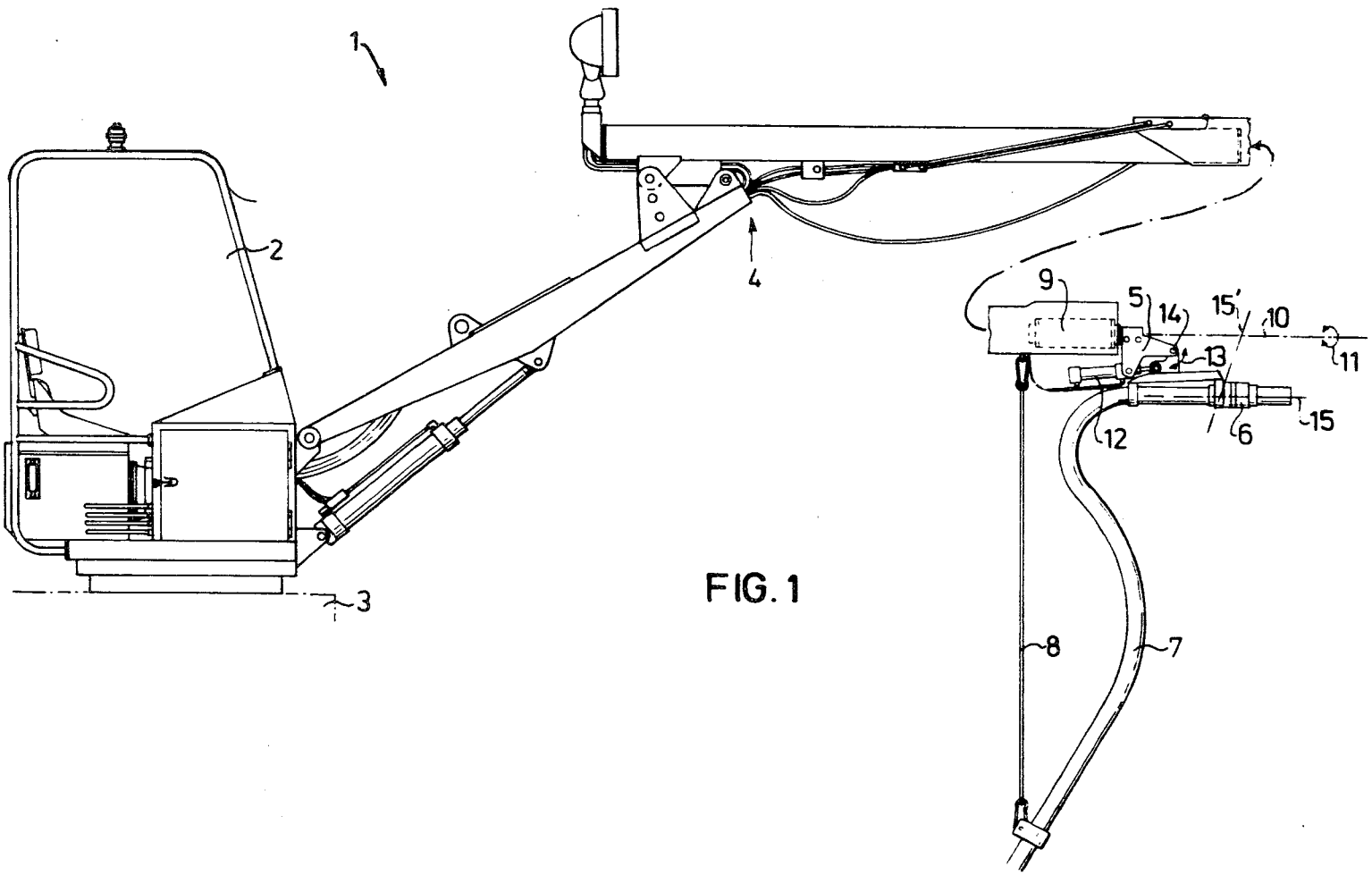

The invention relates to a method of making a swivelling movement about a swivelling axis with a spray nozzle controlled by an operator, especially for spraying concrete, a plane containing the swivelling axis and the longitudinal axis of the spray nozzle swivelling between a first and a second turning position during the swivelling movement when the spray nozzle is caused to swivel by means of a driving mechanism. The invention also relates to an apparatus for carrying out the method.

In applying sprayed concrete on different surfaces, e.g., tunnel roofs, it is known to allow a spray nozzle to carry out a swivelling movement about a swivelling axis. In such a case the speed and sweep of the swivelling movement is usually determined by an operator who makes a swivelling movement with a control lever, synchronous with the spray nozzle, to activate the spray nozzle via a driving mechanism. In the spraying against tunnel roofs, for example, the spray hose connected to the spray nozzle will affect the swivelling movement differently under different phases of the movement. When the spray nozzle is tipped from a position directed straightly upwards, the spray hose opposes the tipping movement, whereas on the other hand it facilitates the tipping movement when the spray nozzle is on its way towards its vertically upwardly directed position. The result of this is that the swivelling movement speed can vary depending on the working position of the nozzle. In order to obtain a uniform concrete coating, it is essential that the speed of the swivelling movement does not vary too much, which is something making great demands on the operator. It is moreover tiring to carry out a desired uniform swivelling movement for a long time.

The object of the invention is to eliminate these known disadvantages and to provide a method and an apparatus enabling simply and effectively desired swivelling of the spray nozzle.

This is achieved by a method proposed according to the invention which is distinguished by the speed of the swivelling movement being kept substantially constant between both turning positions, that an automatic swivelling control unit is engaged for automatic swivelling over a sector between the first and the second turning position, that the operator by overriding the automatic swivelling unit can get the spray nozzle to pass either turning position, and that automatic swivelling is recommenced when the override ceases, whereat swivelling takes place between two new turning positions displaced in the same direction relative to the previous turning positions.

The automatic movement can hereby be just as great in a direction away from each of the two turning positions, or the automatic movement can be greater in a direction away from one turning position than the movement in a direction away from the other turning position.

An apparatus according to the invention for carrying out the method where a spray nozzle, especially for concrete spraying, is arranged for swivelling about a swivelling axis situated in the same plane as the longitudinal axis of the spray nozzle, a driving mechanism being arranged to give the spray nozzle a swivelling movement over a swivelling sector between a first and a second turning position relative the swivelling axis, the direction of action of the driving mechanism being manually adjustable and there being an oscillating motor incorporated in the driving mechanism, is characterized according to the invention by there being arranged in each supply line to the motor an over center valve known per se, by which means the swivelling speed of the spray nozzle is substantially equal in both directions, by a valve for altering the flow direction in the supply lines to the motor being arranged for actuation by an automatic swivelling control unit to achieve automatic swivelling by automatic setting of the valve, and by the automatic swivelling control unit being provided with an operating means with the aid of which it can be overridden for adjusting the swivelling sector position relative to the swivelling axis.

According to the invention, swivelling can thus be carried out automatically between two turning positions, although it is possible to displace the turning position in a desired direction in a simple way during swivelling in progress by manually overriding the automatic system.

Further advantageous embodiments and characterizing features of the invention are apparent from the subordinate claims.

Figure 4:
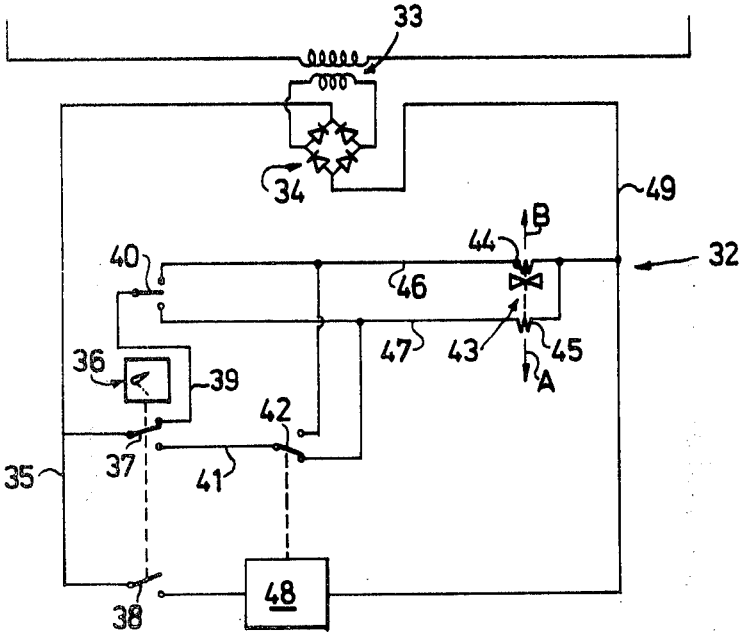
Figure 3:
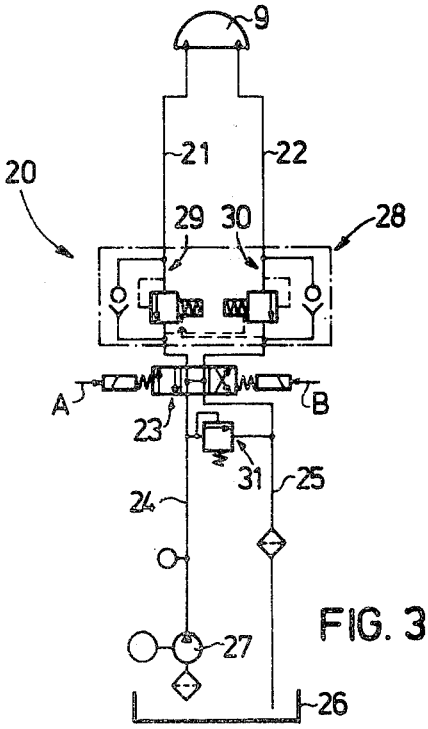
Figure 2:
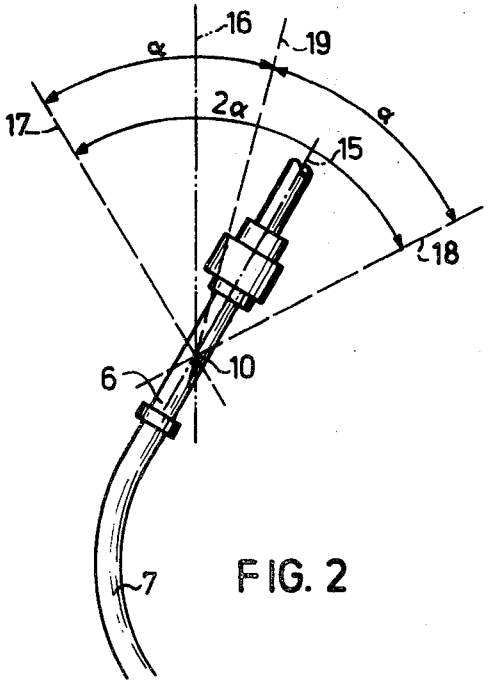
Figure 5:
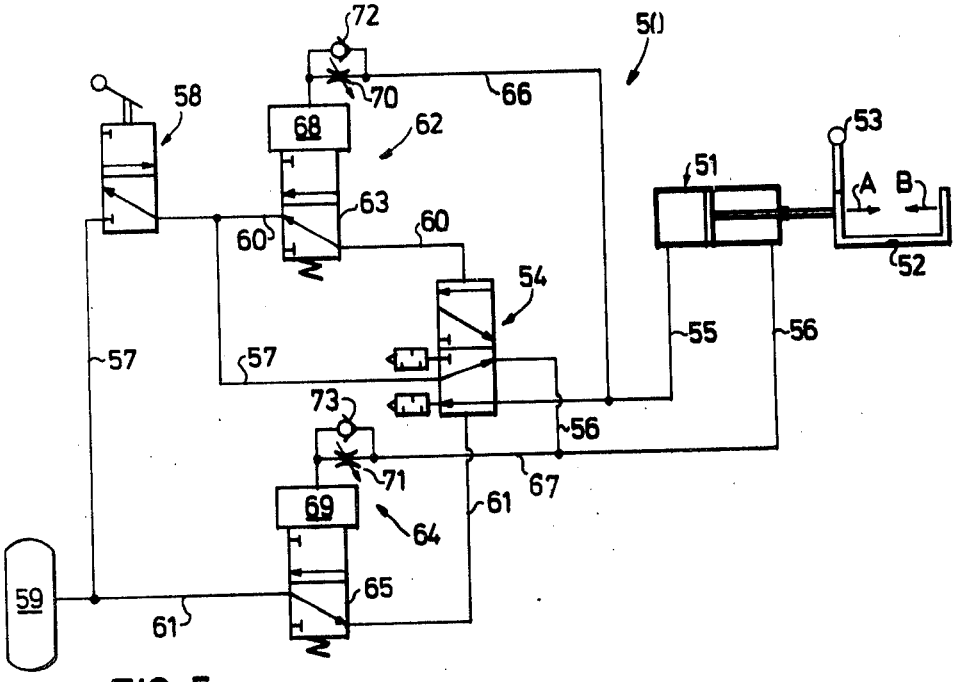
Figure 6:
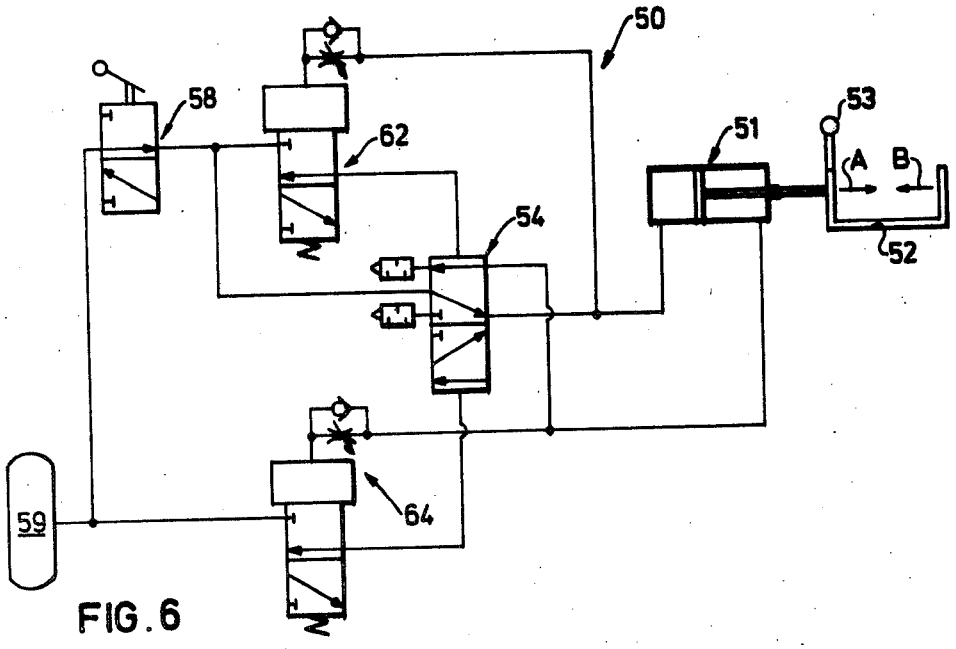

The invention will now be explained more closely in the following with the assistance of embodiment examples shown on the attached drawing, where FIG. 1 shows a side view of a concrete spraying equipment, provided with an apparatus according to the invention, FIG. 2 schematically shows the spray nozzle in different positions, in the vertical plane of FIG. 1, FIG. 3 shows schematically a driving mechanism in an apparatus according to the invention, FIG. 4 shows an electrical automatic swivelling control unit for the driving mechanism in FIG. 3, and FIGS. 5 and 6 show a pneumatic automatic swivelling control unit for the driving mechanism in FIG. 3, in two different working positions.

In a spraying equipment 1 according to the invention there is incorporated an operating cabin 2 carried by a frame 3. The operating cabin 2 is suitably rotatable relative to the frame 3 about a vertical axis in a conventional way, whereat the frame in turn can be raisable and lowerable as well as transportable in the horizontal plane. An arm 4 attached to the operating cabin 2 is movable in the plane of the figure, and has a length which is variable in a conventional manner. At the free end of the arm 4 there is mounted a holder 5 for carrying a spray nozzle 6 which in turn is connected to a spray hose 7. Between the arm 4 and the spray hose 7 there is mounted a relieving device 8 having the task of off-loading the holder 5.

With the aid of a motor 9, the holder 5 is swivellable about a swivelling axis 10 as is apparent from the double arrow 11. With the help of an operating means 12, the spray nozzle 6 can be pivoted in the direction of the double arrow 13 relative to a shaft 14 which is substantially perpendicular to the swivelling axis 10. One such possible position has been denoted by the numeral 15', where the spray nozzle 6 is thus directed slopingly forwards-upwards relative to the operating cabin 2.

In FIG. 2 the figure plane in FIG. 1 has its counterpart in a vertical plane 16. During an arbitrary swivelling movement about the swivelling axis 10, the spray nozzle 16 can, for example, be caused to carry out a swivelling movement between a first turning position 17 and a second turning position 18. From a middle position 19 between these two turning positions 17 and 18, the spray nozzle 6 is thus turned an angle $\alpha$ in either direction. The angle swept through during the swivelling movement will thus have a magnitude equal to $2\alpha$. This swivelling movement can be suited to requirements in different ways as will be apparent later.

A driving mechanism 20 included in the apparatus according to the invention is of the hydraulic type and is shown schematically in FIG. 3. A motor 9, which is suitably of the oscillating type, is connected to a three-positional four-way valve 23 via lines 21 and 22. In its turn, the four-way valve 23 is connected via lines 24 and 25 to an oil tank 26. In the line 24, constituting the supply line, there is a motor-driven pump 27. Between the motor 9 and the four-way valve 23 there is a double over centre valve 28 of known type. In that connection an over center valve 29 is coupled into the line 21, and an over center valve 30 is coupled into the line 22. The over center valves have the task of preventing the hose weight from accelerating the swivelling movement when the spray nozzle is on the way back to a more vertical position from a relatively horizontal position, hereby obtaining an automatic regulation of the swivelling speed. In a known way, there is an overflow valve 31 between the lines 24 and 25.

The four-way valve 23 is adjustable with the help of opposing forces A and B into different positions for altering the working direction of the motor 9. The forces A and B can be provided in a number of different ways according to need and desire.

FIG. 4 shows an automatic swivelling control unit 32 of electrical type for providing the forces A and B. One side of a transformer 33 connected to an a.c. source is coupled to a rectifier 34. A wire 35, connected to the positive terminal of the rectifier 34, is connected to two switches 37 and 38, synchronously operable by means of a setting device 36. The switch 37, which is of the two-pole type, is connected to a switch 40 via a first wire 39 and via a second wire 41 is connected to a switch 42. A relay 43 having two coils 44 and 45 is connected to the switches 40 and 42 by means of wires 46 and 47. The switch 42 is operated by a time relay 48 connected to the switch 38, this relay as well as the relay 43 being connected to the negative terminal of the rectifier 34 by a wire 49.

In the position shown, the automatic swivelling control unit 32 is set for manual swivelling by the setting device 36 being put into position for manual swivelling. The circuit over the switch 38 is thereby open, whereas the switch 37 connects the wires 35 and 39 to each other. In the position shown, there is no current through the manually operated switch 40, but by altering the switch setting, current can be supplied to the wire 46 or 47. Coil 44 or coil 45 will thereby be actuated with the result that an operating force A or B is obtained for adjusting the four-way valve 23 in FIG. 3. As long as there is current in the wire 46, for example, the motor 9 will drive the spray nozzle 6 in one direction. First when the switch 40 is caused to alter its setting so that there is current in the wire 47 instead, the motor 9 and thereby also the spray nozzle 6 will change direction of movement. By operating the switch 40, the desired swivelling movement for the spray nozzle 6 can be obtained.

If the setting device 36 is set to a position for automatic swivelling instead, current will flow through the time relay 48 via the switch 38, and via the switch 37 the circuit over the wire 39 will be broken, while the circuit over the wire 41 is closed instead. The time relay 48 is so made that with fixed or adjustable time intervals it resets the switch 42 so that the wires 46 and 47 will carry current alternately. Thereby there is obtained in the same way as with the manual operation just described operating forces A and B for resetting the setting valve 23 in FIG. 3, made as a four-way valve.

In a pneumatic automatic swivelling control unit 50 shown in FIG. 5 there is included a double-acting cylinder 51 actuating an operating means 52 to provide the resetting forces A and B of the setting valve 23 in FIG. 3. The operating means 52 is provided with a handle 53 for manual operation. A two-position control valve 54 is connected to the cylinder 51 by the lines 55 and 56. A line 57 is connected to the input on the control valve 54, this line being in communication with a compressed air container 59 via a closing valve 58.

The control valve 54 is pneumatically resettable and is therefore connected to two control lines 60 and 61. The control line 60 is connected to the line 57 after the closing valve 58, while the control line 61 is connected to the line 57 ahead of the closing valve 58. Included in a setting means 62, there is a valve 63 which is coupled into the line 60, while in the line 61 there is connected a valve 65 included in a setting means 64. The setting means 62 and 64 are connected via lines 66 and 67 to the lines 55 and 56, respectively.

In each of the setting means 62 and 64, which are made the same, the respective valve adopts a position in response to the pressure in the respective container 68,69 connected to the valve in question. In each of the lines 66 and 67, connected to the containers 68 and 69, respectively, there is a restriction 70 and 71, respectively, which suitably are variable. Non-return valves 72 and 73, closing in the flow direction from the containers 68 and 69, respectively, are coupled parallel with the restrictions 70 and 71.

In the position shown in FIG. 5 the valve 58 is closed, whereby the automatic swivelling control unit 50 is adjusted for manual swivelling via the operating means 52. The cylinder 51 is bled partly via the line 55 and the control valve 54, and partly via the line 56, control valve 54, line 57 and valve 58. This means that the handle 53 can be displaced reciprocally in a desired way without meeting any resistance from the cylinder 51.

FIG. 6 shows the same automatic swivelling control unit 50 as in FIG. 5 but now in another working position. The automatic swivelling control unit has been reset to automatic swivelling by opening the closing valve 58. Since the control valve 54 now is in the position shown, the line 55 is under pressure, with the result that the piston in the cylinder 51 moves to the right in the figure, i.e., provides an operating force A. The container 68 has just been filled via the line 66 and the non-return valve 72, whereby the valve 63 is kept in a closed position. Air leaks simultaneously via the restriction 71, the lines 67 and 56 and the control valve 54 out into the atmosphere. This results in that the operating means 52 continues to move to the right until the container 69 is emptied, thereby allowing resetting of the valve 65 to the position shown in FIG. 5. Via the line 61 air will thereby set the control valve 54 to the position shown in FIG. 5, so that air bleeding of the container 68 is begun and the container 69 is once again filled. Resetting the control valve 54 now results in that the line 56 comes under pressure, whereby the piston in the cylinder 51 will now move to the left instead, the operating means 52 thus having a resetting force B. By regulating the restrictions 70 and 71, the emptying times for the containers 68 and 69 can be regulated, which results in that the movement pattern of the cylinder 51 can be affected in a desired way. By making the emptying times for the containers 68 and 69 just as long, there is obtained a movement of the type shown in FIG. 2, where swivelling takes place between two turning positions 17 and 18, which do not alter position.

By making the emptying time for one container longer than the other, there is obtained instead a swivelling movement where the turning positions are gradually displaced. In one direction the swivelling movement can take place from the turning position 17 to the turning position 18, for example, whereas the swivelling movement in the opposite direction can be less, whereby the turning point occurs before the turning position 17 has been arrived at. In turn, this results in that the next turn takes place after the turning position 18 has been passed, etc. In this way it is thus possible to get the turning positions to gradually move in a definite direction.

The cylinder 51 is suitably so dimensioned that it can be overridden manually with the help of the handle 53. Hereby it will be possible to shorten or extend, as desired, the movement in progress in a certain direction. The result will be that the middle position 19 can be moved. When the handle 53 is released once again, a similar swivelling movement is obtained as before, but now about a middle position displaced in relation to the previous middle position 19. This is of course only applicable under the assumption that the setting of the throttles 70 and 71 has not been changed. Automatic swivelling can be broken off by setting the closing valve 58 to the position shown in FIG. 5. Thereafter manual swivelling can be carried out with the help of the handle 53, if so desired.

Other automatic swivelling control units than those shown here can naturally be used to provide automatic resetting of the setting valve 23.

What I claim is:

1. A method of carrying out a swivelling movement about a swivelling axis (10) with a spray nozzle (6) controlled by an operator, especially for concrete spraying, whereat a plane containing the swivelling axis (10) and the longitudinal axis (15) of the spray nozzle swivels during the swivelling movement about the swivelling axis between a first and a second turning position (17,18), while the spray nozzle (6) is caused to swivel by means of a driving mechanism (20), characterized in that the speed of the swivelling movement is kept substantially constant between both turning positions (17,18), that an automatic swivelling control unit (32,50) is engaged for automatic swivelling over a sector between the first and the second turning positions (17,18), that overriding the automatic swivelling control unit causes the spray nozzle (6) to pass either turning position, and that automatic swivelling is recommenced when the override ceases, whereat swivelling takes place between two new turning positions displaced in the same direction relative to the previous turning positions.

2. A method as claimed in claim 1, characterized in that the automatic movement is just as great in the direction away from each of the two turning positions (17,18), whereby the turning positions retain their positions.

3. A method as claimed in claim 1, characterized in that the automatic movement in a direction away from one turning position is greater than the movement in a direction away from the other turning position, whereby the turning positions are gradually moved.

4. A method as claimed in claim 1 characterized in that the size of the swivelling movement is altered by changing setting means on the automatic swivelling control unit.

5. An apparatus for carrying out the method according to claim 1, where a spray nozzle (6), especially for concrete spraying, is arranged for swivelling about a swivelling axis (10) situated in the same plane as the longitudinal axis (15) of the spray nozzle, there being a driving mechanism (20) arranged to give the spray nozzle (6) a swivelling movement over a swivelling sector between a first and a second turning position (17,18) relative to the swivelling axis (10), the direction of action of the driving mechanism being manually resettable, and there being included in the driving mechanism an oscillating motor 9, and a pair of supply lines leading thereto, characterized in that in each supply line (21,22) to the motor (9) there is arranged an over center valve (29,30), whereby swivelling speed of the spray nozzle (6) is substantially the same in both directions, that a setting valve (23) is adapted to change the flow direction in the supply lines (21,22) of the motor, that an automatic swivelling control unit (32,50) provides for automatic swivelling by automatically resetting the valve (23), and that the automatic swivelling control unit is provided with an operating means (36,53) with the help of which it can be overridden for resetting the position of the swivelling sector relative to the swivelling axis (10).

6. An apparatus as claimed in claim 5, characterized in that the automatic swivelling control unit (32,50) is resettable between manual and automatic swivelling and is provided with control means (40,53) for manual swivelling.

7. An apparatus as claimed in claim 6, characterized in that the automatic swivelling control unit (32) is electric and is provided with two magnetic coils (44,45) which are energizable one at a time and arranged to actuate the setting valve (23) of the driving mechanism (20), and that a time relay (48) is operable for automatic swivelling and is arranged to hold one of the two magnetic coils energized.

8. An apparatus as claimed in claim 6, characterized in that the automatic swivelling control unit (50) is pneumatic and provided with a double-acting cylinder (51) actuating the setting valve (23) of the driving mechanism (20), said cylinder being supplied via a two-way control valve (54) settable by means of two pneumatic control means (62,64).

9. An apparatus as claimed in claim 8, characterized in that in each of the pneumatic control means (62,64) there is included a valve (63,65) which is arranged to close or open a control line (60,61) to the control valve (54), the valve being kept closed against the force from a return spring by the pressure in a pressure container (68,69) when the pressure therein exceeds a predetermined pressure level, that a pair of pressure lines (55 and 56, respectively) connect the pressure containers (68,69) to opposite ends of the double-acting cylinder (51), there being a non-return valve (72,73) connected to the pressure container, and a restriction (70,71) connected in parallel with this non-return valve.

10. An apparatus as claimed in claim 9, characterized in that the restriction (70,71) is variable for regulating the emptying time of the pressure container (68,69) and thereby for also regulating the time taken by a piston of the cylinder (51) to move in either direction.

* * * * *